United States Patent [19]

Schöpwinkel

[11] Patent Number: 4,561,151

[45] Date of Patent: Dec. 31, 1985

[54] METHOD AND APPARATUS FOR RUPTURING SLIVER DURING COILER CAN REPLACEMENT

[75] Inventor: Theo Schöpwinkel, Monchen-Gladbach, Fed. Rep. of Germany

[73] Assignee: Trützschler GmbH & Co. KG, Monchen-Gladbach, Fed. Rep. of Germany

[21] Appl. No.: 628,771

[22] Filed: Jul. 9, 1984

[30] Foreign Application Priority Data

Jul. 7, 1983 [DE] Fed. Rep. of Germany ..... 3324461

[51] Int. Cl.[4] ..... B65H 67/04

[52] U.S. Cl. ..... 19/159 R

[58] Field of Search ..... 19/159 R, 159 A

[56] References Cited

U.S. PATENT DOCUMENTS

| | | | |
|---|---|---|---|
| 3,386,134 | 6/1968 | Munroe et al. | 19/159 A |
| 3,432,891 | 3/1969 | West | 19/157 |
| 4,109,357 | 8/1978 | Burow et al. | 19/159 A |

FOREIGN PATENT DOCUMENTS

| | | | |
|---|---|---|---|
| 1091010 | 4/1961 | Fed. Rep. of Germany . | |
| 1510428 | 1/1974 | Fed. Rep. of Germany . | |
| 2711619 | 2/1979 | Fed. Rep. of Germany . | |
| 2836979 | 3/1980 | Fed. Rep. of Germany . | |
| 586167 | 3/1925 | France . | |
| 40-17087 | 8/1965 | Japan | 19/159 A |
| 1436857 | 5/1976 | United Kingdom | 19/159 A |

*Primary Examiner*—Louis K. Rimrodt

*Attorney, Agent, or Firm*—Spencer & Frank

[57] ABSTRACT

A sliver coiling apparatus has a rotatably supported coiler head including a sliver discharge opening travelling in a circular path upon rotation of the coiler head; a first drive for rotating the coiler head; a support for positioning a coiler can underneath the coiler head such that a central axis of the coiler can is eccentric relative to the circular path; a second drive for moving the support for removing a full coiler can from under the coiler head and positioning an empty coiler can thereunder; a position sensing arrangement for emitting a signal when the sliver discharge opening is situated on an inner half circle of the circular path. The signal is applied to the second drive for energizing the second drive to displace the support when the sliver discharge opening is situated on the inner half circle for effecting rupture of the sliver.

11 Claims, 8 Drawing Figures

METHOD AND APPARATUS FOR RUPTURING SLIVER DURING COILER CAN REPLACEMENT

BACKGROUND OF THE INVENTION

This invention relates to a method and apparatus for rupturing a sliver during coiler can replacement, while the sliver producing apparatus, such as a carding machine, a roller card unit or a drafting unit continues to supply the sliver. The sliver trumpet and calender rolls are rotatably supported.

In a known apparatus, such as disclosed in German Pat. No. 1,091,010, prior to or during the coiler can replacement the distance between the sliver trumpet arranged on the upper portion of the rotary head of the sliver coiler and the downstream arranged calender rollers is increased for a short period of time to such an extent that the sliver breaks between the trumpet and the calender rollers. At the ruptured sliver end, close to the trumpet outlet, a fuzzy fiber beard is formed which prevents the calender rollers from securely grasping the new leading end of the sliver. Further, it is a disadvantage of such a prior art arrangement that while the trumpet dwells in its upwardly swung position, the carding machine continues to supply sliver, but the calender rollers do not withdraw the sliver from the trumpet. This may cause significant operational disturbances. It is a further disadvantage that the provision of a pivotal plate and a driven plunger constitute an excessively complex construction.

German Offenlegungsschrift (application published without examination) No. 1,510,428 discloses an apparatus wherein during the can replacement the distance between the sliver feeding device and the uppermost sliver coil in the can may be lengthened for a short period of time to an extent as to cause rupture of the sliver. In this known apparatus the rotating sliver channel in the rotary coiler head is, prior to the removal of the full can, immobilized in a position in which the outlet of the sliver channel is oriented in a direction opposite to that in which the coiler can is removed. This known arrangement has the disadvantage that because of immobilizing the sliver channel, a continuous supply of the sliver during coiler can replacement does not take place. Since the differential speed between the stationary sliver channel and the outwardly moving coiler is insufficient for securely rupturing the sliver, the sliver channel is arranged obliquely with respect to the longitudinal axis of the coiler can in order to ensure a sharp deflection of the sliver at the outlet of the sliver channel.

SUMMARY OF THE INVENTION

It is an object of the invention to provide an improved method and apparatus of the above-outlined type from which the discussed disadvantages are eliminated and which, in particular, ensures in a structurally simple manner a secure rupturing of the sliver and a continuing supply thereof by the sliver feeding device without operational disturbances.

This object and others to become apparent as the specification progresses, are accomplished by the invention, according to which, briefly stated, during the replacement of the coiler can the distance between the sliver feeding device, such as the calender rollers or the sliver outlet opening and the uppermost sliver coil in the coiler can is increased for a short period of time such that the sliver is ruptured.

Thus, according to the invention, the sliver is separated from the filled can in the course of an automatic can replacing process in a simple manner and without the need of auxiliary mechanisms. The sliver is supplied without interruption and is introduced into the automatically installed empty coiler can.

It is of importance to remove the full coiler can rapidly to securely effect rupture of the sliver. Thus, there must be ensured a sufficient difference between the velocity ($v_{KW}$) of the coiler can to be replaced and the velocity ($v_B$) of the sliver discharged by the sliver feeding device to securely effect rupture of the sliver.

As a sensor responding to the filled condition of the coiler can determines that the coiler can is full, an electric signal is applied to the sliver feeding device, for example, to the calender rollers, the rotary head of the sliver coiler, or the like, whereupon the sliver feeding device changes from a high speed to a low speed. Thereafter, an electric signal is applied by the sliver feed drive to the motor for the coiler can transporting apparatus, whereupon the full coiler can is moved away in such a manner that the path of its displacement is greater than the sliver length which is delivered by the sliver feeding device during the coiler can replacement process. In this manner, a secure breakage of the sliver and a continuing delivery of the sliver by the sliver feeding device are ensured.

Preferably, the coiler can is moved away from the coiler at a moment when the sliver outlet opening is, during its orbital travel, situated on the "inner half circle" of its path. At that location, the pressure of the sliver against the underside of the pressing plate of the rotary head has its greatest value so that in this manner a "natural" clamping location is obtained. The other clamping location is formed, for example, by the calender rollers or the sliver discharge opening. The sliver is ruptured between the two clamping locations. In the moment of sliver rupture the directions of motion of the sliver discharge opening in the coiler head and that of the coiler can with the deposited sliver are opposite to one another. If such directional relationships are ensured, a lesser speed difference suffices.

During the can replacement process a speed difference ($\Delta$ v) has to be present between the delivery speed ($v_V$) of the sliver and the velocity ($v_{KW}$) of the can to be replaced, that is, the path of the displacement travelled by the full coiler can during the replacement process has to be always greater than the sliver length which is delivered during the can replacement process. The position of the sliver discharge opening in the rotary head of the coiler has to be situated during the can replacement process at all times in that zone of its circular path where the deposited sliver has the highest density in the full can. This is the zone in which, during the can replacing process, the velocities of the sliver and the can have opposite directions. A sliver rupture may occur by means of the velocity difference ($\Delta$ v) and the exact position of the sliver outlet opening during the can replacement process only when the outer forces which immobilize (clamp) the sliver are greater than the inner, cohesion forces of the sliver (for example, adhesion forces or transverse forces of the fibers). The rupture of the sliver occurs between two clamping locations. One clamping location is the calender roller pair in the rotary head of the sliver coiler with which the sliver is once again compressed for deposition in the can. The other clamping location is the frictional force between the underside of the rotary head plate and the rotary head of the sliver coiler and the deposited sliver in the can. The required frictional forces are generated by means of the can filling. The magnitude of the differential velocity ($\Delta$ v) and the required can filling are dependent upon the origin of the raw fiber, the fiber length, the fineness of the fiber, the crinkled state of the fiber, the fiber surface (matte, glossy, etc.), the sliver weight, the diameter and height of the can as well as the spring forces generated within the can.

Expediently, the speed of the sliver feed is set to be smaller than the displacement velocity of the full coiler can during replacement. By using a d.c. current for driving the sliver coiler and thus the rotary head, the sliver feeding speed may be reduced in a simple manner.

According to a preferred structural embodiment of the invention, there are provided a sensor device having a stationary sensor element and a position indicating element which is secured to the rotary head and which is associated with the inner half circle of the orbital path of the sliver discharge opening. Expediently, the sensor device is connected with the filling sensor for the coiler can and the driving device for the rotary head. According to a further advantageous feature of the invention, the sensor device is connected with the drive motor for the turnstile-like coiler can support. Expediently, the sensor element is a proximity-responsive device and the position indicator is a metal component.

According to a further advantageous feature of the invention, above the coiler can supporting turnstile there is arranged a flat clamping element which is in contact with the lower surface of the rotary head holder or the rotary head.

DESCRIPTION OF THE PREFERRED EMBODIMENTS

Figure 1A:
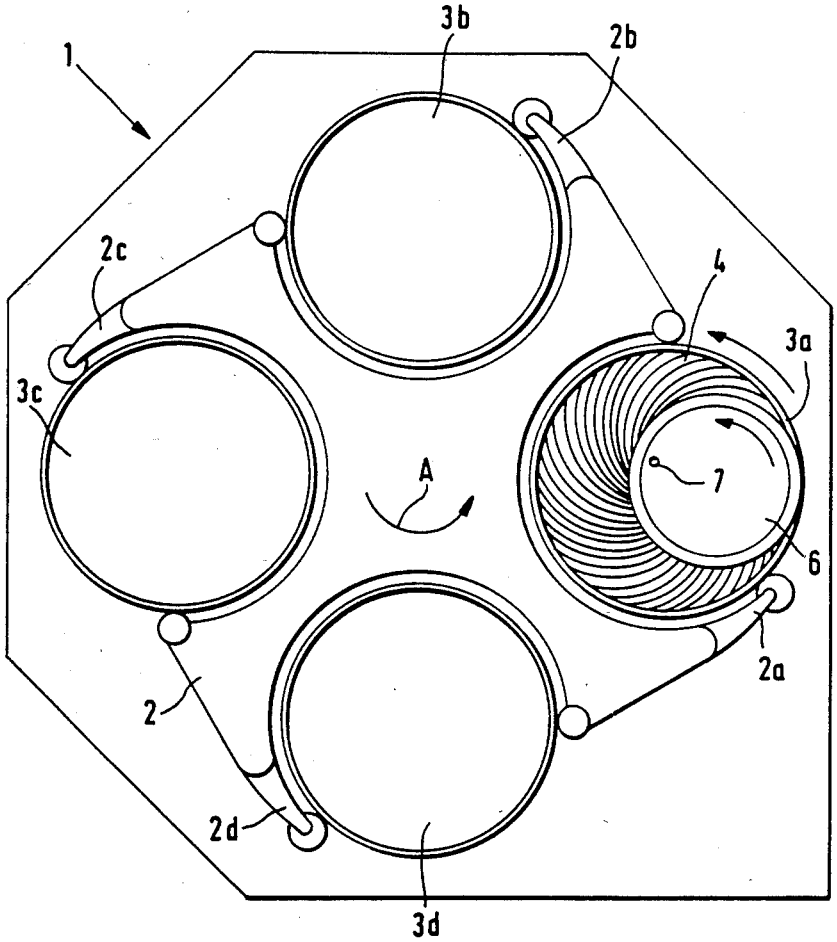
FIG. 1*a* is a top plan view of a first position of a coiler can exchanger which is adapted to incorporate the invention.

Turning to FIG. 1*a*, there is illustrated a coiler can exchanger which is of known construction and which is described, for example, in German Offenlegungsschrift (application published without examination) No. 2,414,860. The apparatus has a turnstile 2 having four arms 2*a*, 2*b*, 2*c* and 2*d*. The turnstile 2 defines bays of circular confines within which coiler cans 3*a*, 3*b*, 3*c* and 3*d* are arranged. A sliver 4 is being deposited into the coiler can 3*a* in an annular configuration by means of a rotary head 6 of a sliver coiler. Cans 3*b*, 3*c* and 3*d* are shown empty. The can 3*a* is driven by a drive motor of a sliver coiler (not shown) in a counterclockwise direction. The coiler can 3*a* is arranged underneath the rotary coiler head 6 which is supported in a coiler head plate (not shown in FIG. 1*a*). The rotary head 6 also rotates in a counter-clockwise direction and has a sliver discharge opening 7. In the position of the coiler can exchanger 1 illustrated in FIG. 1*a* the sliver 4 which is delivered by the sliver discharge opening 7 is deposited in the coiler can 3*a* in multilayer coils. In order to effect coiler can replacement to exchange a full can with an empty one, the turnstile 2 is rotated, together with the cans 3*a*–3*d*, in the direction of the arrow A.

Figure 1B:
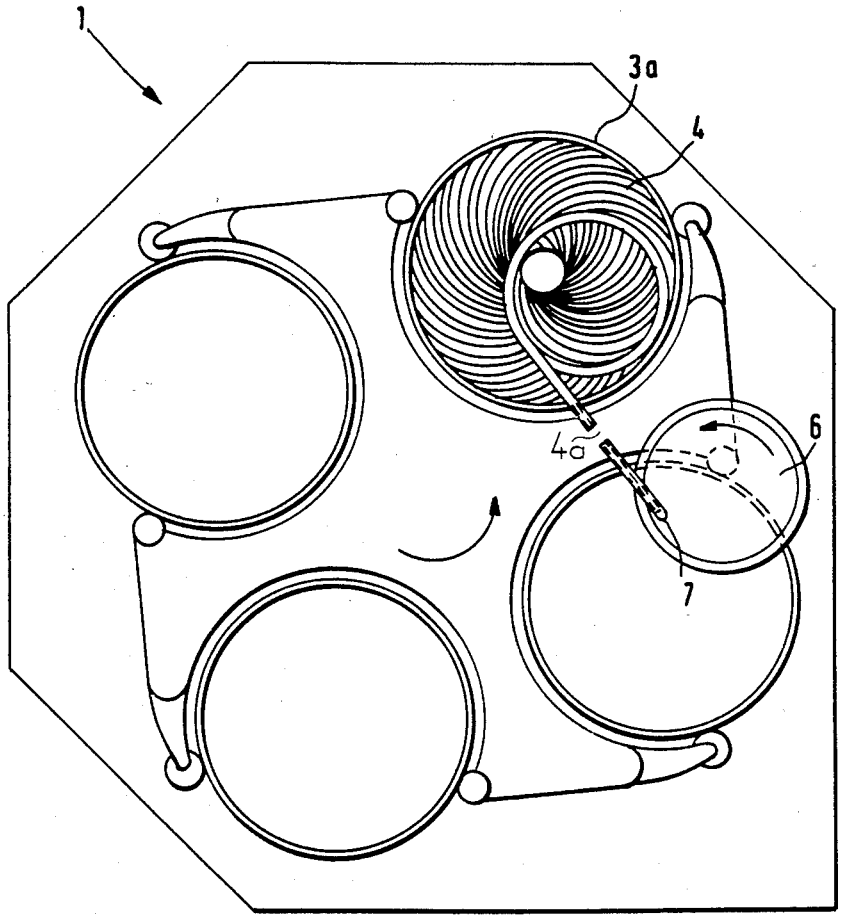
FIG. 1*b* is an illustration similar to that of FIG. 1*a*, showing the coiler can exchanger in a second position.
Figure 2:
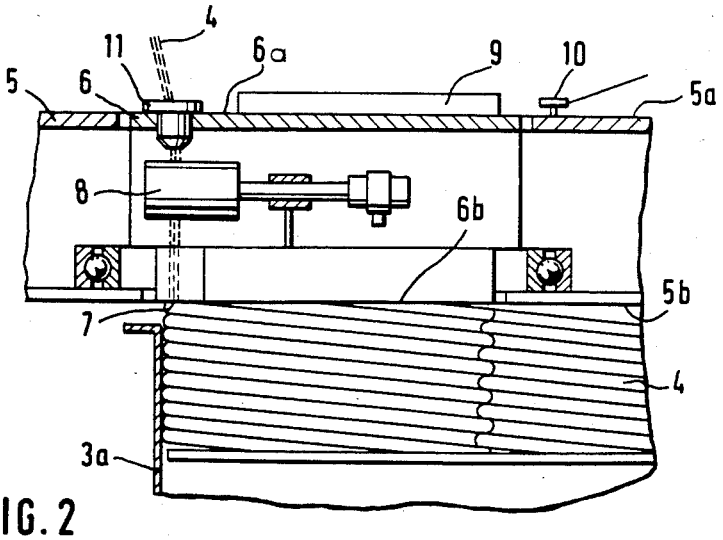
FIG. 2 is a schematic fragmentary sectional side elevational view of a preferred embodiment of the invention.

The coiler can exchange, that is, the rotation of the turnstile 2 occurs, according to the invention at the moment when the sliver discharge opening 7 is situated on that semicircle of its circular path which is oriented towards the center of the coiler can 3*a*. This half circle is designated as the "inner half circle". As a result, during coiler can exchange, two oppositely oriented displacements occur, namely, the motion of the coiler can 3*a* together with the sliver 4 deposited therein in one direction and a displacement of the sliver discharge opening 7 (which delivers sliver into the can) in the other, opposite direction. At the same time, two clamping locations for the sliver are formed, namely, between the uppermost coil of the sliver 4 and the lower face 6*b* of the rotary head 6, on the one hand and between the calender rollers B and the sliver discharge opening 7 on the other hand, as shown in FIG. 2. By increasing the distance between the two clamping locations, the sliver 4 is ruptured at 4*a* as shown in FIG. 1*b*.

Figure 1C:
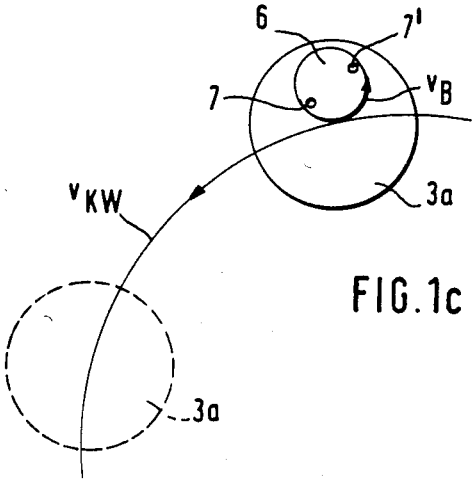
FIG. 1*c* is a diagram illustrating a local displacement of a coiler can and the sliver discharge opening of the coiler head before and after coiler can exchange according to the invention.

Turning to FIG. 1*c*, the coiler can 3*a*, during the coiler can exchange, moves from a first position (shown in solid lines) along a circular path into a second position (shown in phantom lines) with a velocity ($v_{KW}$) of, for example, 15–25 m/min. During the coiler can exchange, the sliver discharge opening 7 of the rotary head 6 moves from the position 7 into the position 7' during its counterclockwise travel, while the sliver 4 exiting from the sliver discharge opening 7 moves with a velocity ($v_B$) of, for example, 5–15 m/min.

Figure 3:
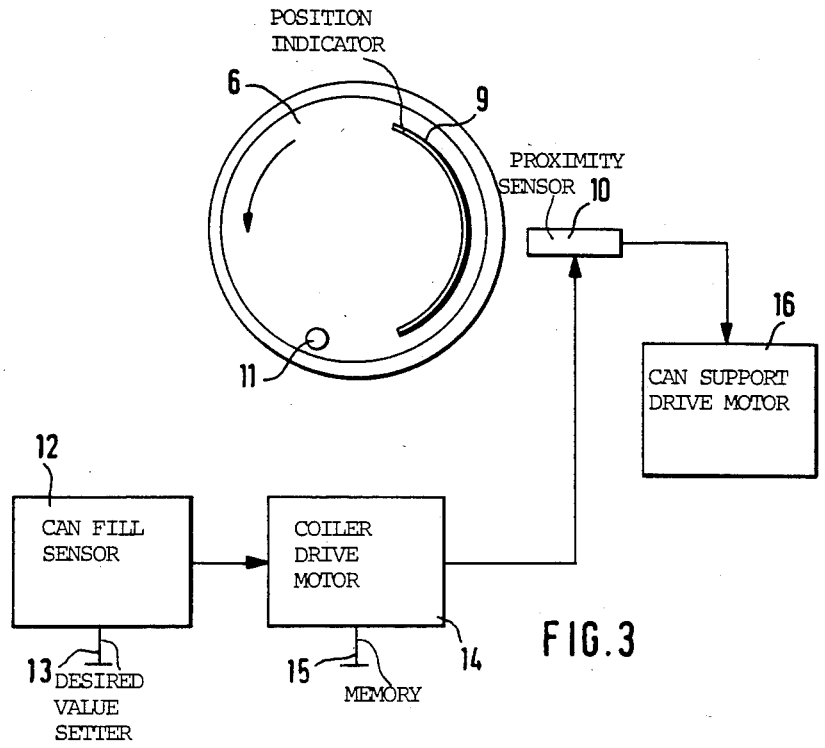
FIG. 3 is a schematic top plan view of the structure of FIG. 2 and a block diagram of a driving system according to the preferred embodiment.

Turning now to FIG. 2, the position of the rotary head 6 is sensed by the cooperation of a position indicator element 9 and a measuring element 10. The position indicator element 9 comprises, for example, a strip-like sheet metal element which is secured to the upper surface 6*a* of the rotary head 6 approximately semicircularly as shown in FIG. 3. The position indicator 9 is, as viewed in the direction of rotation, arranged downstream of the sliver trumpet 11, that is, downstream of the sliver discharge opening 7 which is situated vertically underneath the trumpet 11. The measuring element 10 is, for example, a proximity sensor which is, as shown in FIG. 2, mounted on a top face 5*a* of the rotary head holder 5, immediately adjacent the circular travelling path of the position indicator 9.

Referring once again to FIG. 3, a measuring member (can fill sensor) 12 is provided to sense the extent of fill in the coiler can 3*a* during operation. When a desired deposited sliver length (for example, 5,000 meters) stored in a desired value setter 13 is reached, an electric signal is applied by the can fill sensor 12 to a drive motor 14 which is preferably a d.c. motor and which rotates the rotary head 6 with the intermediary of the coiler can drive. In this manner, the sliver velocity is reduced to a value of, for example, 15 m/min. stored in a memory 15. The velocity of the rotary head 6 is also reduced. Simultaneously, an electric signal is applied to the proximity sensor 10 which is thus placed in a standby condition. As the position indicator 9 moves past the frontal side of the activated proximity sensor 10, the latter emits an electric signal and applies it to a drive motor 16 which rotates the turnstile 2. As a result, the latter turns in a counterclockwise direction and thus, the coiler can 3*a* is moved away from the filling position (see FIGS. 1*a*, 1*b*). During this occurrence, the sliver 4 is ruptured.

Figure 4:
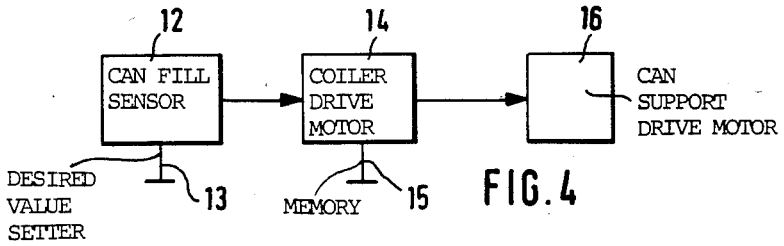
FIG. 4 is a block diagram for driving a coiler can support according to another preferred embodiment.

Turning now to the block diagram shown in FIG. 4, contrary to the arrangement in the embodiment of FIGS. 2 and 3, no sensor device is provided for determining the angular position of the measuring head 6. Thus, the system shown in FIG. 4 may be used in a case where the velocity difference between the velocity ($v_{KW}$) of the coiler can to be replaced and the delivery speed ($v_B$) of the sliver emerging from the sliver discharge opening 7 is sufficiently large to ensure a rupture of the sliver.

The invention may find application in coiler structures where the can exchanging device is rotary or linear as well as in coiler structures where the coiler can is stationary or rotates during the sliver coiling operation (the rotation of the can may be in the same direction or in an opposite direction relative to that of the sliver coiling).

Figure 5A:
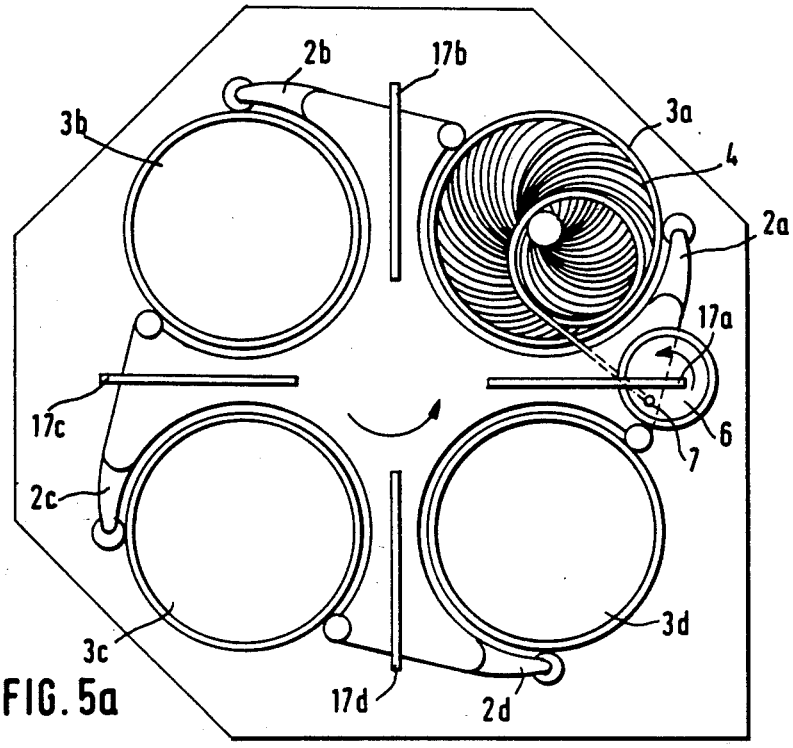
FIG. 5*a* is a top plan view of a coiler can exchanger including sliver clamping elements acordiong to a further preferred embodiment of the invention.
Figure 5B:
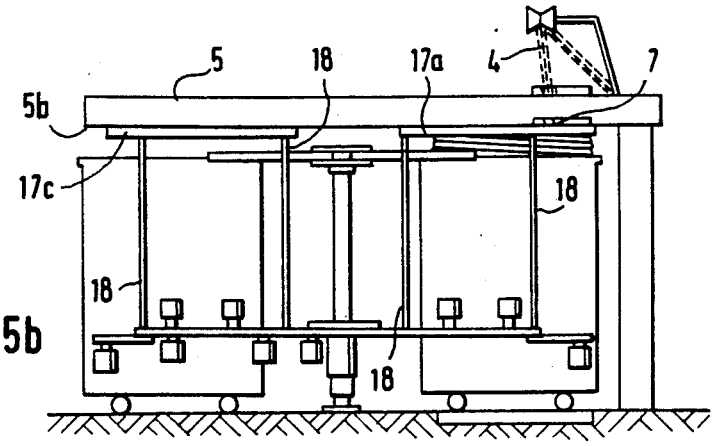
FIG. 5*b* is a schematic side elevational view of the structure illustrated in FIG. 5*a*.

Turning now to FIGS. 5*a* and 5*b*, above each arm 2*a*–2*d* of the turnstile 2 there is provided a respective flat clamping element 17*a*, 17*b*, 17*c* and 17*d* which is formed essentially of a flat strip-like structure made preferably of a flexible material such as a plastic. As shown in FIG. 5*b*, the clamping elements 17*a*–17*d* are mounted on the respective arms 2*a*–2*d* by means of rod-like supports 18. The upper edge or surface of the clamping elements 17*a*–17*d* is in contact with the lower surfaces 5*b* and 6*b* of the rotary head holder 5 and the rotary head 6, respectively. In operation, the clamping elements 17*a*–17*d* form an additional clamping location situated between the sliver discharge opening 7 and the coiler can 3*a*: the sliver 4 is thus clamped between the upper edge or surface of the clamping elements 17*a*–17*d* and the lower faces 5*b* and 6*b* of the coiler head support and the coiler head, respectively, during can replacement (that is, when the turnstile 2 rotates). The sliver 4 ruptures between the clamping elements 17*a*–17*d* and the calender rollers 8.

It will be understood that the above description of the present invention is susceptible to various modifications, changes and adaptations, and the same are intended to be comprehended within the meaning and range of equivalents of the appended claims.

What is claimed is:

1. A method of depositing sliver from a sliver producing apparatus into a coiler can, comprising the following steps:

(a) delivering the sliver from a sliver feeding device of a rotating coiler head into the coil can to build superposed sliver coils therein; said sliver feeding device orbiting in a circular path eccentrically with respect to the coiler can undergoing filling;

(b) replacing a full coiler can with an empty coiler can underneath the coiler head;

(c) rupturing the running sliver simultaneously with the replacing step; said rupturing step comprising the step of increasing the distance between said sliver feeding device of the coiler head and an uppermost sliver coil in the full coiler can for a short period at a time when said sliver feeding device is situated on an inner half circle of said circular path; said inner half circle being oriented towards a central axis of the coiler can undergoing filling; said step of increasing the distance being effected to an extent sufficient to cause rupture of said sliver; and (d) continuing to deliver sliver from the sliver feeding device of said coiler head during said replacing and rupturing steps.

2. A method as defined in claim 1, further comprising the step of setting, for said rupturing step, the velocity of the sliver discharged from said sliver delivering device smaller than the velocity of the removal travel of the full coiler can from under said coiler head.

3. A method as defined in claim 1, wherein said replacing step comprises the step of moving the full coiler can through a path which is longer than the length of silver delivered during said replacing step.

4. A sliver coiling apparatus comprising (a) a rotatably supported coiler head including a sliver discharge opening travelling in a circular path upon rotation of the coiler head;

(b) a first driving means for rotating said coiler head;

(c) support means for positioning a coiler can underneath said coiler head such that a central axis of said coiler can is eccentric relative to said circular path; said coiler can receiving sliver from said sliver discharge opening;

(d) a second driving means for moving said support means for removing a full coiler can from under the coiler head and positioning an empty coiler can thereunder;

(e) a position sensing means for emitting a signal when said sliver discharge opening is situated on an inner half circle of said circular path; said inner half circle being oriented towards a central axis of the coiler can undergoing filling from said sliver discharge opening;

(f) means for applying said signal to said second driving means for energizing said second driving means to displace said support means when said sliver discharge opening is situated on said inner half circle for effecting rupture of the sliver.

5. A sliver coiling apparatus as defined in claim 4, wherein said sensor means comprises a position indicator affixed to said coiler head and a position sensor supported adjacent said coiler head and being arranged for emitting said signal in a predetermined position of said position indicator.

6. A sliver coiling apparatus as defined in claim 5, wherein said position sensor is a proximity sensor responding to said predetermined position of said position indicator.

7. A sliver coiling apparatus as defined in claim 5, wherein said position indicator is a metal component.

8. A sliver coiling apparatus as defined in claim 4, further comprising (g) a fill sensor means for emitting an additional signal in response to a predetermined filled state of the coiler can undergoing sliver filling; and (h) means for applying said additional signal to said first driving means for reducing the velocity of sliver delivery from said sliver discharge opening and means for applying a further signal from said first driving means to said position sensing means for placing said position sensing means in a standby state.

9. A sliver coiling apparatus as defined in claim 4, wherein said support means comprises a rotatably arranged turnstile having a plurality of circumferential means for receiving coiler cans in a circular array; each said circumferential means including an arm arranged to circumferentially extend over and engage outer side surfaces of the coiler cans and a flat sliver clamping element in engagement with an underside of said coiler head.

10. A sliver coiling apparatus comprising (a) a rotatably supported coiler head including a sliver discharge opening travelling in a circular path upon rotation of the coiler head;

(b) a first driving means for rotating said coiler head;

(c) support means for positioning a coiler can underneath said coiler head such that a central axis of said coiler can is eccentric relative to said circular path; said coiler can receiving sliver from said sliver discharge opening;

(d) a second driving means for moving said support means for removing a full coiler can from under the coiler head and positioning an empty coiler can thereunder;

(e) a fill sensor means for emitting a signal in response to a predetermined filled state of the coiler can undergoing sliver filling; and (f) means for applying said signal to said first driving means for reducing the velocity of sliver delivery from said sliver discharge opening and means for applying a further signal from said first driving means to said second driving means for energizing said second driving means to displace said support means.

11. A sliver coiling apparatus as defined in claim 10, wherein said support means comprises a rotatably arranged turnstile having a plurality of circumferential means for receiving coiler cans in a circular array; each said circumferential means including an arm arranged to circumferentially extend over and engage outer side surfaces of the coiler cans and a flat sliver clamping element in engagement with an underside of said coiler head.

* * * * *